US006433491B2

(12) United States Patent
Halberstadt

(10) Patent No.: US 6,433,491 B2
(45) Date of Patent: Aug. 13, 2002

(54) ENERGY CONVERTER HAVING A CONTROL CIRCUIT

(75) Inventor: Johan Christiaan Halberstadt, Nijmegen (NL)

(73) Assignee: Koninklijke Philips Electronics N.V., Eindhoven (NL)

( * ) Notice: Subject to any disclaimer, the term of this patent is extended or adjusted under 35 U.S.C. 154(b) by 0 days.

(21) Appl. No.: 09/828,086

(22) Filed: Apr. 6, 2001

(30) Foreign Application Priority Data

Apr. 10, 2000 (EP) ..... 00201282

(51) Int. Cl.[7] ..... H05B 37/02
(52) U.S. Cl. ..... 315/224; 363/123
(58) Field of Search ..... 315/224, 225, 315/276, 291, 307; 363/123, 124

(56) References Cited

U.S. PATENT DOCUMENTS 4,673,852 A * 6/1987 Geiger ..... 318/341
5,075,599 A 12/1991 Overgoor et al. ..... 315/224
5,463,281 A * 10/1995 Linssen ..... 315/208 R
5,654,591 A * 8/1997 Mabboux et al. ..... 307/66
5,696,431 A * 12/1997 Giamnopoulos et al. .... 315/308
6,031,743 A * 2/2000 Carpenter et al. ..... 363/65
6,327,164 B1 * 12/2001 Shinkawa ..... 363/124

* cited by examiner

*Primary Examiner*—Don Wong
*Assistant Examiner*—D. A. Minh
(74) *Attorney, Agent, or Firm*—Aaron Waxler

(57) ABSTRACT

The invention relates to an energy converter for supplying electric energy from an energy source to a load. The converter comprises a transformer having a primary side and a secondary side, the secondary side being adapted to be connected to the load. At least a first and a second controllable switch are arranged in series with each other for generating an alternating current in the primary side of the transformer. The energy converter also comprises a control device for generating control signals with which the first and the second switch are opened and closed. The control device comprises a detector for generating a detection signal when the energy converter is operative in a capacitive or near-capacitive mode. To generate the detection signal, the detector detects a voltage jump that occurs at a mode between the first and the second switch when the first or the second switch is closed.

9 Claims, 4 Drawing Sheets

ENERGY CONVERTER HAVING A CONTROL CIRCUIT

BACKGROUND OF THE INVENTION

The invention relates to an energy converter for supplying electric energy from an energy source to a load, the energy converter comprising a transformer having a primary side and a secondary side, the secondary side being adapted to be connected, in operation, to the load, at least a first and a second, series-arranged, controllable switch to be connected, in operation, to the energy source for generating an alternating current in the primary side of the transformer, diodes arranged anti-parallel to the first and the second switch, and a control device for generating control signals with which the first and the second switch are opened and closed, the control device comprising detection means for generating a detection signal when the energy converter is operative in a capacitive or near-capacitive mode.

An energy converter of this type is known per se from, inter alia, U.S. Pat. No. 5,075,599 and U.S. Pat. No. 5,696,431. In this converter, the load is often a rectifier and the energy source is a DC voltage source. Together with the load, the energy converter has for its object to convert a DC input voltage of the energy source into a DC output voltage of the load. However, the load may also comprise a different device than the rectifier, which device is fed with an alternating voltage. The energy converter may thus consist, inter alia, of a DC/DC converter and a DC/AC converter.

For a satisfactory operation of the energy converter, it is important that the switches for generating the alternating current are switched on and off at the right instant. The frequency at which the switches are switched on and off defines the mode of operation of the converter. If the frequency is sufficiently high, the energy converter operates in a regular inductive mode. In this mode, the phase of the current through the primary side of the transformer trails the phase of the voltage at the node. After a current-conducting switch is opened, and after the diode of the other switch has started to conduct the current, the other switch can be opened. In that case, there are no switching losses. The time interval in which both switches are opened is referred to as the non-overlap time.

The converter operates in the near-capacitive mode when the switching frequency of the switches, and hence the frequency of the alternating current through the primary side of the transformer is decreased to a point where the alternating current is at least almost in phase with the alternating current at the node. After the current conducting switch is opened and before the diode, which is arranged anti-parallel to the other switch, starts to conduct, the direction of the current through the primary side of the transformer is reversed. Hard-switching takes place if the other switch is closed in that case. This means that switching takes place at an instant when there is a voltage difference across the relevant switch. This will result in switching losses.

The converter operates in the capacitive mode when the frequency at which the switches are switched is further decreased to a point where the alternating current through the primary side of the transformer is in phase with, or even leads the phase of the voltage at the node. The switching losses also occur in this mode.

Generally, it is desirable that the energy converter operates in the inductive mode.

The known detection means are often used to prevent the energy converter from operating in the near-capacitive mode or in the capacitive mode. If the near-capacitive mode is detected, the control device may raise the frequency at which the switches are switched so that the converter will certainly start working again in the inductive mode. The frequency may be raised in a number of small steps per cycle of the converter, or in one big step, all this being dependent on detection of either the near-capacitive mode or the capacitive mode.

In accordance with the state of the art, two methods of detecting the (near-) capacitive mode are known. First, it is known that the detection means determine whether the converter operates in the near-capacitive mode with reference to the current through the converter during the non-overlap time, or with reference to the polarity of the current of the converter. This method is known from U.S. Pat. No. 5,075,599. In the near-capacitive mode, this current is small with respect to this current in the inductive mode. In the capacitive mode, the polarity of the current is opposed to the polarity of the current in the inductive mode. The amplitude of the current is therefore often compared during the non-overlap time with the reference value for determining whether the energy converter is operative in the (near-) capacitive mode.

Secondly, it is known to detect a current peak across a capacitor which is incorporated between the node and, for example, one of the terminals of the energy source. This method is known from U.S. Pat. No. 5,696,431. If such a current peak occurs, it is an indication that the energy converter switches hard and is therefore operative in the (near-)capacitive mode.

The known techniques provide the possibility of detecting whether the converter is operative in the capacitive mode or in the near-capacitive mode. One of the most important reasons for ensuring that the energy converter is not operative in the (near-) capacitive mode is the dissipation which occurs in the switches due to hard-switching. Hard-switching may indeed be minimized by means of the known techniques described above. It can therefore be prevented by means of the known techniques that hard-switching takes place because, in the case of detection of the capacitive or near-capacitive mode, the frequency of the energy converter is adapted in such a way that the converter becomes operative in the inductive mode again.

A drawback of the known method in which the current through the converter, or the polarity of the current through the converter is determined during the non-overlap time is that the control device adapts the frequency in such a way that the energy converter becomes amply operative in the inductive mode when the detection means of this control device detect that the energy converter is operative in the capacitive mode or the near-capacitive mode. Amply operative in this respect means that the frequency is raised more than is necessary to cause the converter to operate in the inductive mode. This in turn means that the range of the power which can be supplied to the load is unnecessarily limited.

The method in which a current peak is detected is only suitable for detecting hard-switching as such. It is not possible for determining the amplitude of hard-switching. In fact, hard-switching takes place when a switch is closed at the instant when there is still no voltage difference across the switch. This voltage difference is a measure of hard-switching. The larger the voltage difference, the harder switching takes place and the larger the switching losses in the switches. For this reason, the latter method is only suitable for adapting the frequency in such a way that the converter becomes operative in the inductive mode again when hard-switching has been detected. There is no question of a fine control with which the converter can be just brought to the inductive mode without raising the frequency to an unnecessarily high extent.

SUMMARY OF THE INVENTION

It is an object of the invention to provide an energy converter with which the drawbacks described can be alleviated, if desired. The invention is also based on the recognition that it will provide a great advantage when it is possible to define the amplitude upon hard-switching. The foregoing means that it is desirable to determine the voltage across a switch just before the instant when it is closed. In that case, it has been made possible to create a control loop, if desired on the basis of this information, which control loop utilizes said voltage difference across the relevant switch in a feedback circuit for controlling the frequency at which the switches of the energy converter are switched. In other words, a control loop can be created for controlling the frequency of the alternating current generated by the energy converter in the transformer. The frequency of the energy converter can thus be controlled in such a way that there is only a small voltage difference across the switch at the instant when it is switched, so that, in the inductive mode, switching takes place near the boundary of the near-capacitive mode. It is thereby achieved that the output power of the converter has a maximal range. Accordingly, the invention is characterized in that, for the purpose of generating the detection signal, the detection means are adapted to detect a voltage jump which occurs at a node between the first and the second switch when the first or the second switch is closed.

Since, according to the invention, the voltage jump is measured, it can be determined very accurately in how far the energy converter is operative in the capacitive mode or the (near-)capacitive mode. Since the mode in which the energy converter is operative is accurately known, the frequency of the energy converter can be adapted very accurately accordingly and as desired.

Particularly, it holds that the value of the detection signal is a measure of the value of the voltage jump.

In accordance with a further elaboration of the invention, it holds that the detection means for generating the detection signal are adapted to detect a voltage jump which occurs at a node between the first and the second switch when the first or the second switch is closed. The detection signal may then be formed by the voltage Vdiv or a related quantity. Particularly, it holds that the switching frequency at which the first and the second switch are switched is adjusted by the control device in dependence upon the detection signal. This adjustment may be such that the frequency is operative in the inductive mode, however, bordering on the near-capacitive mode. In that case, the power that can be supplied by the energy converter has a maximal range. To this end, particularly the control device is adapted to adjust, in operation, the switching frequency in such a way that the value of Vdiv reaches a selected relatively small value.

In operation, the control device will re-open the short-circuit switch after the sample-and-hold circuit has determined the voltage Vdiv. The sample-and-hold circuit preferably retains the voltage Vdiv until the new value of Vdiv is determined. The detection signal is therefore preferably equal to the most current value of Vdiv.

These and other aspects are apparent from and will be elucidated with reference to the embodiments described hereinafter.

DETAILED DESCRIPTION OF THE PREFERRED EMBODIMENT

Figure 1:
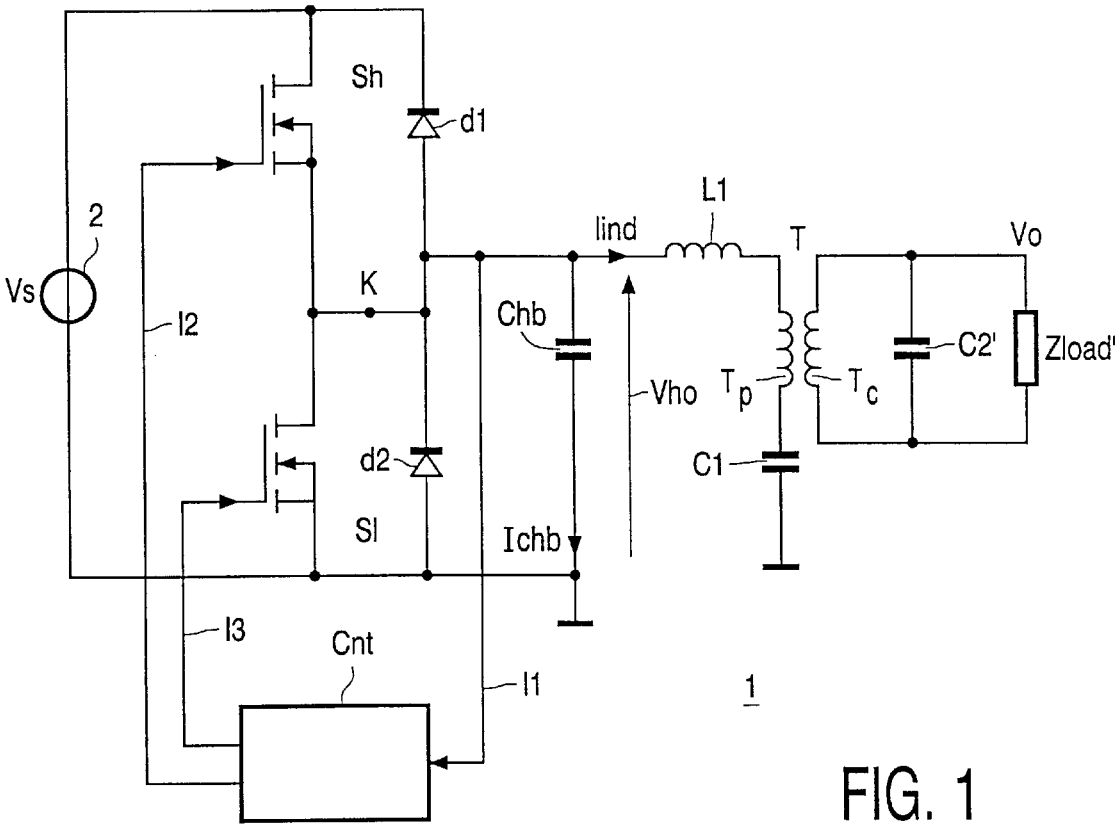
FIG. 1 shows a possible embodiment of an energy converter.

The reference numeral 1 in FIG. 1 denotes a possible embodiment of an energy converter. This energy converter may be in the form of an energy converter in accordance with the state of the art and as an energy converter according to the invention. The energy converter as operative in accordance with the state of the art will be discussed first.

In this embodiment, the energy converter 1 is formed as a resonant half-bridge converter. The energy converter 1 is adapted to supply electric energy to a load Zload' from an energy source Vs, a DC energy source in this embodiment. In this embodiment, the energy source Vs generates a DC voltage Vo. The energy converter comprises a transformer T having a primary side Tp and a secondary side Tc. Moreover, the energy converter comprises a first controllable semiconductor switch Sh and a second controllable semiconductor switch S1 which are arranged in series with each other. The first switch Sh and the second switch S1 are interconnected at a node K. The first and second semiconductor switches Sh and S1 may be, for example, a transistor, a thyristor a MOSFET, etc. The first switch Sh is arranged anti-parallel to a body diode d1. The second switch S1 is arranged anti-parallel to a body diode d2. The node K is connected via a coil L1 to the primary side Tp of the transformer T. The energy converter further comprises a capacitance C1, with the coil L1, the primary side Tp and the capacitance C1 being arranged in series with one another. In this embodiment, the capacitance C1 is arranged between the primary side Tp of the transformer T and ground. In this embodiment, one side of the power supply source Vs is also connected to ground. However, it is alternatively possible to connect the capacitance C1 to the side of the power supply source Vs which is not connected to ground.

The energy converter further comprises a capacitance C2' which is arranged parallel to the load Zload' on the secondary side of the transformer 2. The load Zload' may be a device which operates at an alternating voltage. This device may in turn be, for example, a rectifier for obtaining a DC voltage.

The energy converter further comprises a capacitance Chb which is arranged in such a way that it smoothes the value of a change of the voltage at the node K per unit of time. In this embodiment, the capacitance Chb is arranged between the node K and ground. However, the capacitance Chb may be alternatively arranged between the node K and the side of the power supply source Cs which is not connected to ground. Alternatively, the capacitance Chb may in principle consist of a parasitic capacitance of elements of the energy converter.

The energy converter is further provided with a control device Cnt for controlling the first and the second switch Sh, S1 via leads 12 and 13, respectively. The control device Cnt thus defines the instants when the first and second switches Sh and S1 are opened and closed. In this embodiment, an input of the control device is connected to the node K via a lead 11.

Figure 2:
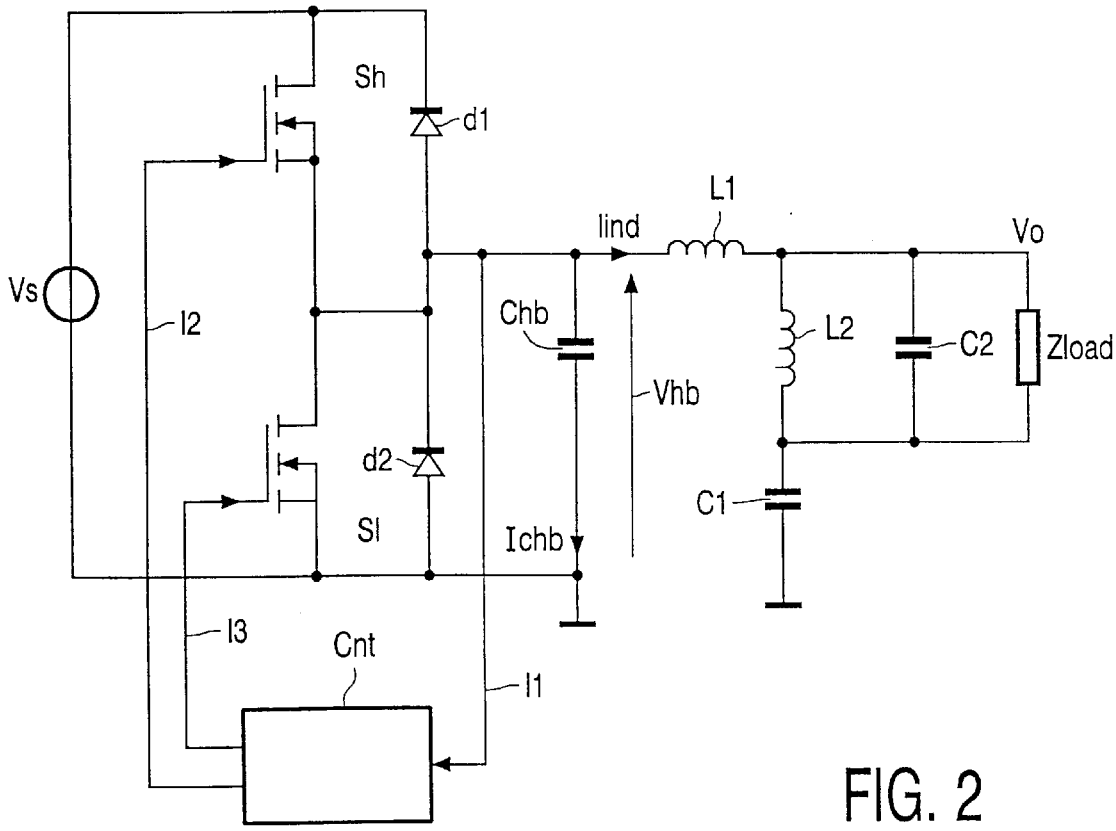
FIG. 2 is a circuit diagram of the energy converter shown in FIG. 1, in which components located on a secondary side of the transformer of the energy converter are transformed to a primary side of the transformer.

When the capacitance C2' and the load Zload' are transformed in known manner to the primary side of the transformer T, an equivalent circuit diagram of the energy converter of FIG. 1 is obtained, as is shown in FIG. 2. The coil L2 replaces the transformer T, the capacitance C2 replaces the capacitance C2', and Zload replaces the load Zload'.

FIG. 2 shows some currents and voltages which will be elucidated hereinafter. The voltage Vhb at the node K is a square wave during normal use. For computing the transfer characteristics, a first harmonic approximation may be used, in which only the fundamental frequency is considered. The higher harmonics can be ignored because the frequencies of these components are far apart from the resonance frequency of the energy converter. Moreover, it holds that the contribution of these higher harmonics to the output (Zload) is negligible.

If the capacitor C1 has a sufficient value, it may also be ignored. If Zload has an infinitely large impedance, it holds for the resonance frequency:

$$Wp = \frac{1}{\sqrt{Lp \cdot C2}}$$

In this case, Lp is a parallel arrangement of the coils L1 and L2:

$$Lp = \frac{L1 \cdot L2}{L1 + L2}$$

In practice, Zload will, however, be a finite impedance, which results in a shift of the resonance frequency.

Figure 3A:
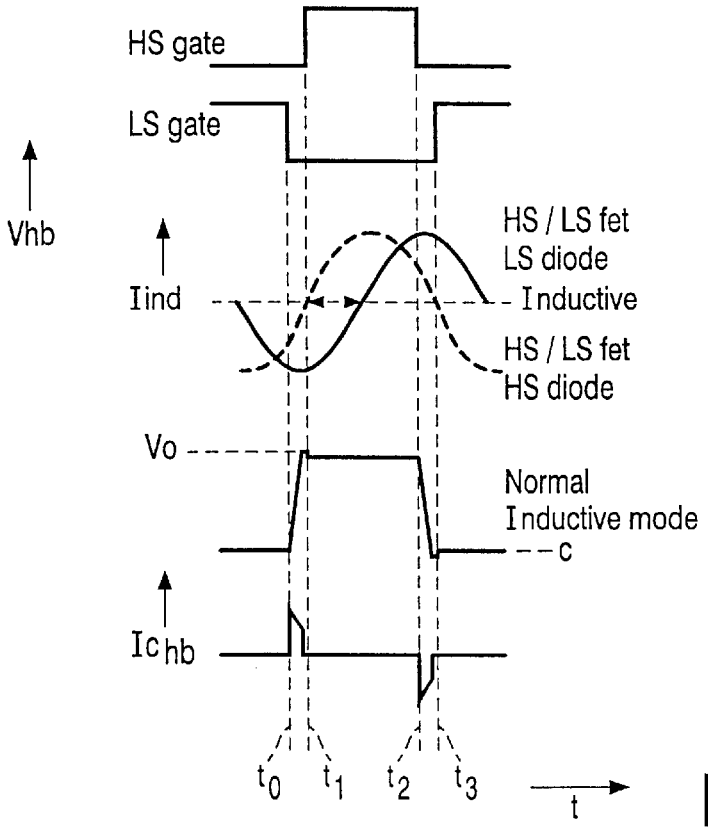
FIG. 3*a* shows various voltages and currents of the energy converter according to FIG. 1, when this converter is operative in the inductive mode.

FIG. 3*a* shows the waveforms when the energy converter operates in the inductive mode. Here, Hs gate is the switching signal which is applied to the first switch Sh. When this switching signal is high, the switch Sh is closed, i.e. conducting. The signal Hs gate is applied by the control device Cnt to the relevant switch. The signal Ls gate is the control signal which is applied by the control device Cnt to the second switch S1. It appears therefrom that both switches will never be closed simultaneously. If this were the case, there would be a short circuit. The significance of the other signals is directly apparent from FIG. 3*a*. In the inductive mode, the phase of the current Iid trails the (fundamental harmonic of the) voltage Vhb of the half-bridge circuit, i.e. the voltage at the node K in this embodiment. The fundamental harmonic of the voltage Vhb is denoted by a broken line in the Iind diagram. After the conducting switch (for example, the first switch Sh) is opened at the instant t0, the current Iind will charge the capacitor Chb. After subsequently the body diode (d2) of the other switch (this is the switch which has not just been opened) starts conducting, this other switch S1 can be closed at the instant t1. Then there is no noticeable voltage across this switch. In that case, there are no switching losses. The interval t0-t1 in which both switches are opened is referred to in this case as the non-overlap time. This phenomenon is repeated with inverted voltages and currents when the switch S1 is opened at instant t2 and the switch Sh is closed at instant t3, while the body diode d1 conducts current. The non-overlap time is the interval t2-t3.

FIG. 3*a* shows by means of Hs/Ls Fet and Ls diode that, if Iind is larger than 0, the current Iind flows through the switch Sh, the switch S1 or the diode d2 arranged anti-parallel to the switch S1. Similarly, Hs/Ls Fet and Hs diode indicate that, when the current Iind is smaller than 0, this current flows through the switch Sh, the switch S1 or the diode d1 arranged anti-parallel to the switch Sh.

Figure 3B:
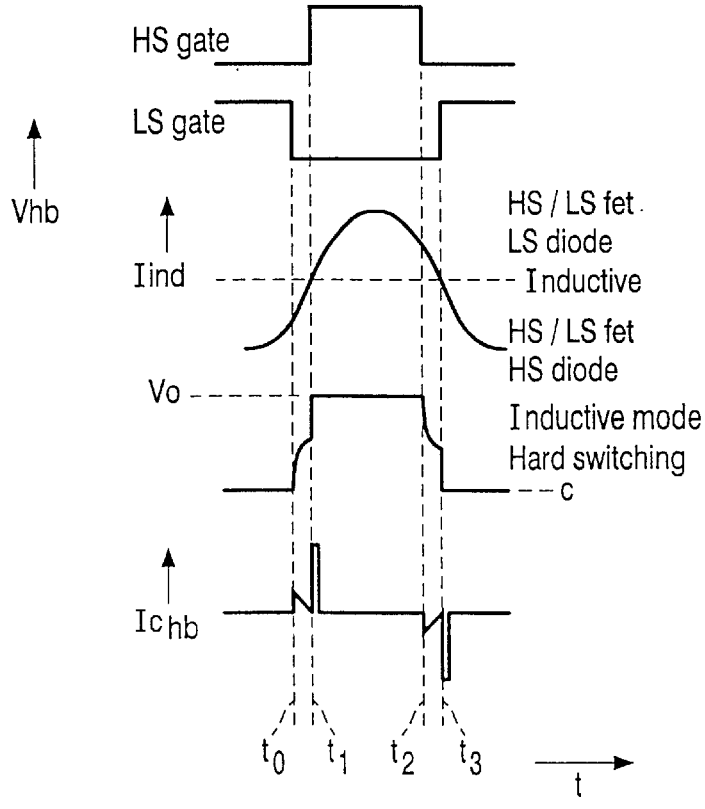
FIG. 3*b* shows various voltages and currents of the energy converter shown in FIG. 1, when this converter is operative in the near-capacitive mode.

FIG. 3*b* shows the diagrams of FIG. 3*a* when the switching frequency of the energy converter is decreased to a point at which the current Iind is almost in phase with the (fundamental harmonic of) the voltage Vhb, but is still inductive. After the conducting switch Sh or S1 is opened, the current Iind will start charging the capacitance Chb, but before the diode (d1 or d2) of the other switch starts conducting, the direction of the current Iind is reversed. At the instant when the direction of the current Iind is reversed, the slope of Vhb is equal to 0. As is clearly apparent from FIG. 3*b*, the voltage Vhb at the node K is smaller at the instant t1 than the power supply voltage Vs applied to the switch Sh. In other words, there is a voltage across the switch Sh. When the switch Sh is subsequently closed at the instant t1 (Hs gate becomes high), hard-switching takes place at which switching losses occur. The voltage across the switch Sh disappears within a fraction of a second, and the voltage at the node K and the voltage Vhb jump to the value of the power supply voltage of the power supply Vs. This results in a short-lasting current peak of Ichb after the instant t1, as is shown in FIG. 3*b*. This phenomenon is repeated when the switch Sh is opened at the instant t2 and when subsequently the switch S1 is closed at the instant t3 after the non-overlap time t3-t2 has elapsed. Hard-switching also takes place when the switch S1 is closed. The mode described with FIG. 3*b* is referred to as the near-capacitive mode.

Figure 3C:
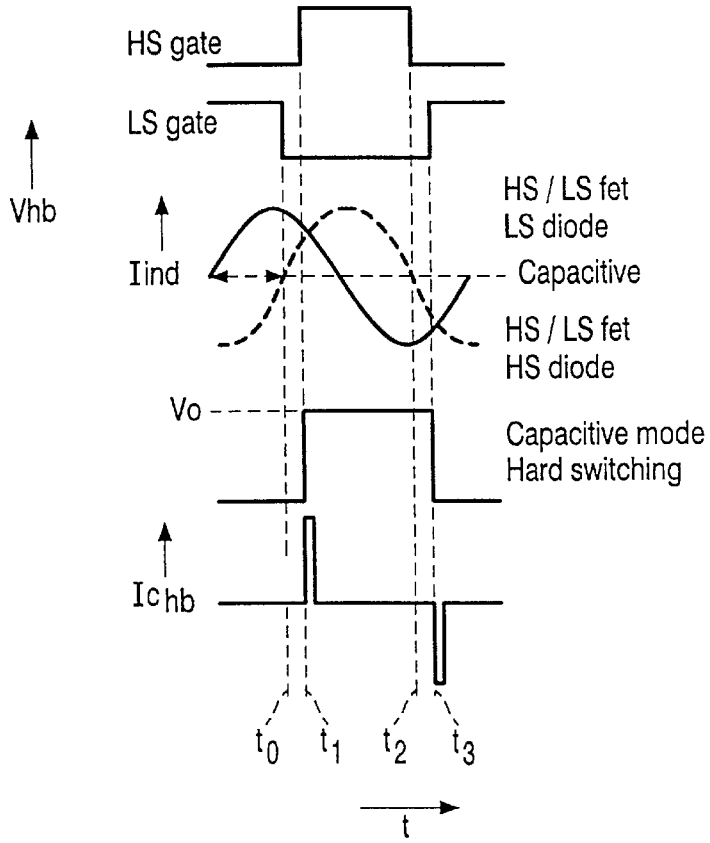
FIG. 3*c* shows various voltages and currents of the energy converter shown in FIG. 1, when this converter is operative in the capacitive mode.

In the diagrams shown in FIG. 3*c*, the frequency of the energy converter is decreased to a point at which the current Iind is in phase with the (fundamental harmonic of) the half-bridge voltage Vhb or even leads the half-bridge voltage in phase. In that case, the capacitor Chb is not charged at all. This is apparent from FIG. 3*c* in which the voltage Vhb remains equal to 0 between the instants t0 and t1. When the switch Sh is therefore closed at the instant t1, there is a voltage difference across this switch which is equal to the power supply voltage Vo. When the switch Sh is closed, hard-switching thus again takes place and switching losses occur.

The desired mode in which the energy converter is operative is the mode in accordance with FIG. 3*a*, in which the current Iind is inductive and switching losses are minimal.

In this case it is desired that the frequency of the energy converter is not chosen to be unnecessarily large to cause the energy converter to operate in the inductive mode. The range of the power that can be supplied by the energy converter to the load would thereby be limited unnecessarily. The energy converter is therefore preferably operative in the inductive mode, bordering on the near-capacitive mode. The control device Cnt which may be used for such a purpose is described with reference to FIG. 5. The control device comprises two series-arranged capacitances Cb and Cs which are arranged between the node K and their reference voltage, ground in this example. The control device also comprises a short-circuit switch S1 which is arranged parallel to the capacitance Cb. The control device further comprises a sample-and-hold circuit S&H for measuring a voltage Vdiv across the capacitance Cb. The output signal of the sample-and-hold circuit S&H is applied to a processor P2. The processor P2 generates control signals on leads 12 and 13 for opening and closing the switches Sh and S1, respectively. The processor P2 also generates control signals for opening and closing the switch S1 on lead 14. The processor P2 also generates control signals on lead 15 for controlling the sample-and-hold circuit S&H.

Figure 4:
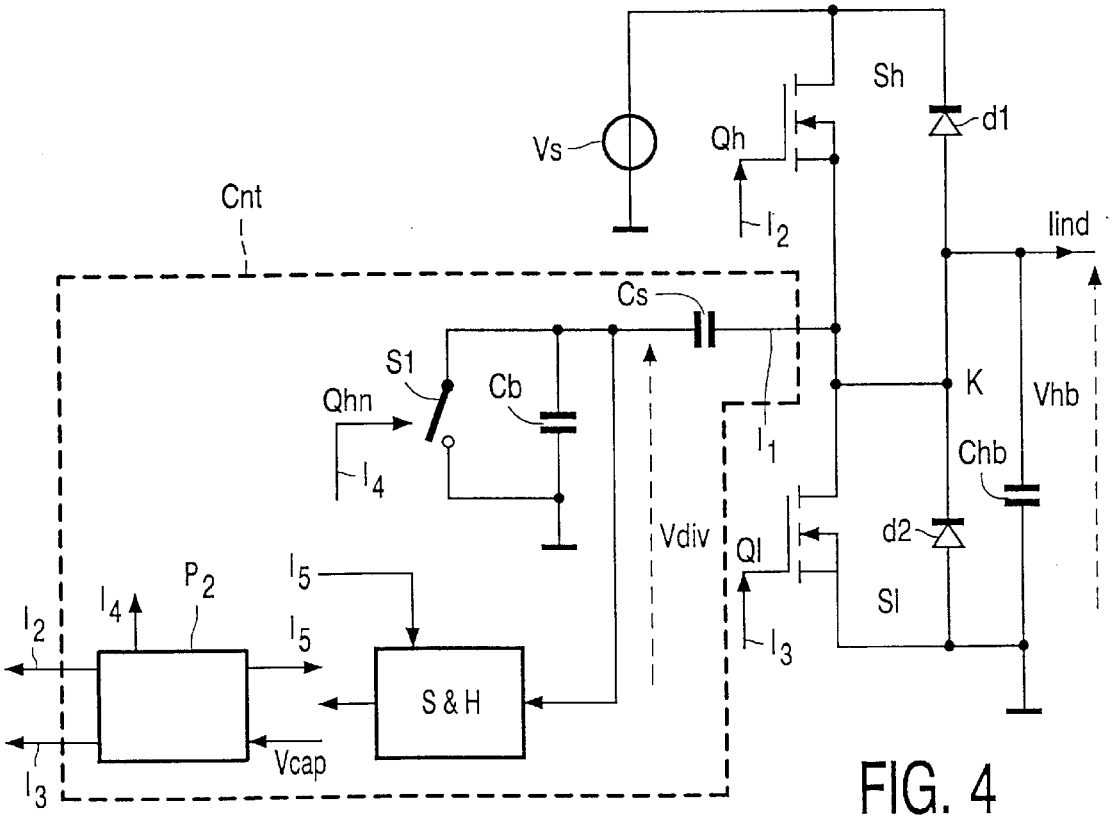
FIG. 4 shows a possible embodiment of a part of the control device of an energy converter according to the invention.

The capacitances Cb and Cs, the switch S1, the sample-and-hold circuit S&H and the processor P2 jointly constitute detection means for generating a detection signal (here the output signal of the sample-and-hold circuit S&H), when the energy converter is operative in the capacitive or near-capacitive mode. For generating the detection signal, the detection means are adapted to detect a voltage jump occurring at the node K between the first and the second switch S1 and Sh when the first or the second switch is closed. The value of the detection signal is then a measure of the value of the voltage jump in this example. The detection means operate as follows (see FIGS. 4 and 5). In this embodiment, the operation of the detection device is described for a positive slope of Vhb. However, the device may also be used in the case of a negative slope of Vhb.

At the end of a conducting period, the switch S1 is opened at the instant t0. The switch S1 is then closed so that the capacitance Cb remains in an uncharged state.

In the inductive or near-capacitive mode, the current Iind is negative at that instant. Consequently, the capacitances Chb and Cs will be charged. After the capacitance Chb has been charged to the voltage V0, the diode d1 will start conducting and the switch Sh can be closed at the instant t1. This switch is operated in known manner by the processor P2. However, when the switch Sh is closed, the processor P2 also closes the switch S1 according to the invention. Since the voltage at the node K is at least substantially equal to the voltage of V0 of the power supply source in the inductive mode at that instant, hard-switching does not take place. In other words, the voltage change dVhb/dt is at least substantially equal to 0 (see also FIG. 5) at the instant when the switch Sh is closed. This in turn means that the capacitance Cb is not charged.

In the near-capacitive mode, the current Iind is negative at the instant when the switch S1 is closed (see also FIG. 3*b*). However, the current Iind changes sign before the voltage Vhb reaches the value of V0. In this mode, the voltage Vhb will even generally not reach the value of V0 and will even decrease after a maximum value which is smaller than V0. This instant, the instant when dVhb/dt reaches an extreme value is detected in known manner by the control device Cnt. It is known, for example, to provide the control device with means for comparing the value of a quantity which relates or is equal to the value of a change of the voltage per unit of time at the node K of the first and the second switch, on the one hand, with a threshold value, on the other hand, for determining the switching instants of the first and the second switch. More particularly, the instant t1 when the other switch (here switch S1) must be closed, is determined by measuring the current flowing through a capacitance of the energy converter, which capacitance is incorporated in the energy converter in such a way that it reduces the value of the change of the voltage at the node per unit of time. This switch is closed at the instant when the value of this current decreases and becomes equal to a relatively small positive threshold value. In accordance with a practical elaboration, the switching instant t1 is determined by comparing the voltage across the current-sense resistor with a reference voltage by means of a comparator. This sense resistor may be arranged in series with said capacitance, or it may be incorporated in the alternating current path via a capacitive current divider.

It is also feasible that other methods are used for determining the instant when the current Iind is inverted and dVhb/dt reaches an extreme value. Whatever method is used, at this instant t1 the processor P2 switches the switch S1 in such a way that it is opened. The processor P2 also ensures that the switch Sh is closed simultaneously. As a result, both the capacitance Chb and the series-arranged capacitances Cs and Cb are charged to the power supply voltage V0 via the switch Sh. As a result, a voltage Vdiv will occur across the capacitance Cb. This voltage is sampled by the sample-and-hold circuit S&H. The sample-and-hold circuit S&H generates an output voltage Vcap which is equal to the voltage Vdiv which has just been determined and is a direct measure of the voltage across the switch Sh at the instant when it is closed. Vcap is thus a measure of the voltage jump occurring at the node K when the switch Sh is closed and, hence, this voltage is a good indication of the (near-)capacitive mode.

Figure 5:
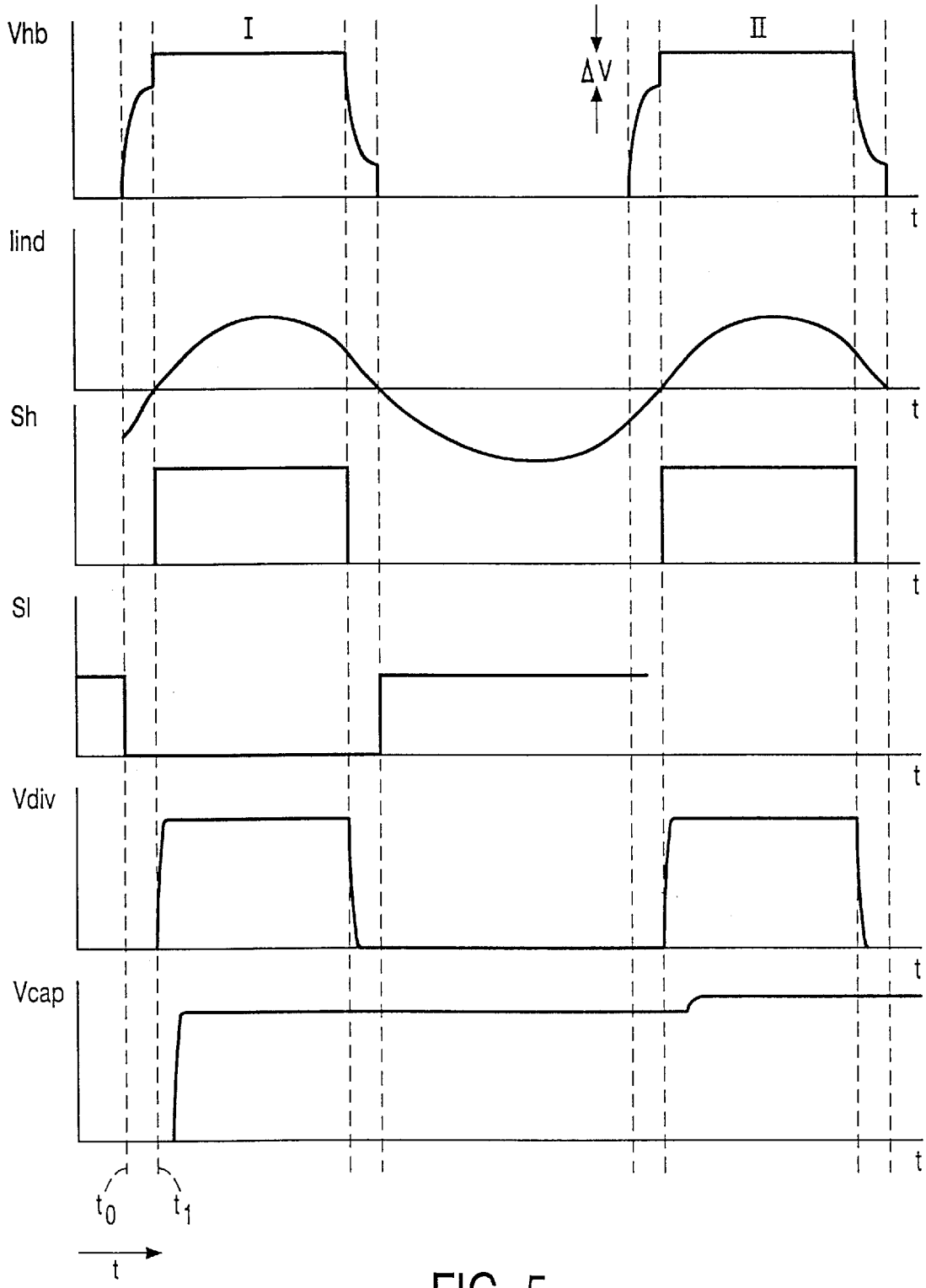
FIG. 5 shows a voltage and current diagram to illustrate the operation of the control device when the energy converter is operative in the inductive mode bordering on the near-capacitive mode.

The voltage Vcap which constitutes the afore mentioned detection signal which is a measure of the value of the voltage jump at the node K upon hard-switching, is applied to the processor P2. The processor P2 may be adapted, for example, in such a way that it controls the switching frequency of the switches Sh and S1 and hence the frequency of the alternating current Iind in such a way with reference to Vcap that the energy converter is operative in the inductive mode bordering on the near-capacitive mode. To this end, the processor P2 controls the frequency at which the switches Sh and S1 are switched, such that Vcap, and hence Vdiv, are controlled to a predetermined relatively small positive value. The switches Sh and S1, the capacitances Cb and Cs, the switch S1, the sample-and-hold circuit S&H as well as the processor P2 constitute a feedback circuit which controls the frequency in such a way that Vcap has a positive value and approximates zero as closely as possible, for which purpose it is controlled to said predetermined value in this example. All this is shown in FIG. 5. FIG. 5 shows how the value of Vcap is related to the value of the voltage across the relevant switch (upon hard-switching) and to the value of Vdiv. The frequency at which the switches Sh and S1 are switched in this case in FIG. 5 is a frequency at which the converter is operative at the boundary between the capacitive mode and the near-capacitive mode.

The invention is by no means limited to the embodiments described hereinbefore. For example, the frequency can be controlled in an entirely analog way on the basis of a negative slope dVhb/dt. The voltage Vdiv which is then detected will have a negative value. The value of Vcap will also be negative. The feedback loop must then ensure that Vcap must then have a minimal absolute value. It is of course also possible to control simultaneously at the positive value of Vcap at the negative value of Vcap. In that case, the control is such that the absolute value of Vcap becomes minimal. This control may also be employed in a full-bridge circuit. In this case, the converter has four switches which are arranged pair-wise simultaneously.

The instant when the switches Sh and S1 must be closed can also be determined in a manner different from that described above. It is, for example, feasible that the control device Cnt is also adapted to determine a reached maximum value of a given magnitude, in this example the current Ichb through the capacitance Chb, while subsequently a threshold value is determined on the basis of this determined maximum value. Particularly, the threshold value may be chosen to be equal to a factor K times the maximum value of Ichb, in which K has a value which is between 1 and 0. The control device is then provided with means for comparing a value of a quantity which relates or is equal to the change of the voltage per unit of time at the node K, on the one hand, (in this example the current Ichb), or dVhb/dt, with the threshold value, on the other hand, for determining the switching instants. In this example, these are the switching instants when the switches Sh and S1 are closed in any case. The instants when the switches are opened may be determined in known manner. Such variants are considered to be within the scope of the invention.

What is claimed is:

1. An energy converter for supplying electric energy from an energy source to a load, the energy converter comprising a transformer having a primary side and a secondary side, the secondary side being adapted to be connected, in operation, to the load, at least a first and a second series-arranged, controllable switch to be connected, in operation, to the energy source for generating an alternating current in the primary side of the transformer, diodes arranged anti-parallel to the first and the second switch, and a control device for generating control signals with which the first and the second switch are opened and closed, the control device comprising detection means for generating a detection signal when the energy converter is operative in a capacitive or near-capacitive mode, wherein, for the purpose of generating the detection signal, the detection means are adapted to detect a voltage jump which occurs at a node between the first and the second switch when the first or the second switch is closed.

2. An energy converter as claimed in claim 1, characterized in that the value of the detection signal is a measure of the value of the voltage jump.

3. An energy converter as claimed in claim 2, characterized in that the detection means comprise a first and a second capacitance which are arranged in series between a reference voltage and the node, a short-circuit switch is arranged parallel to the second capacitance, and a sample-and-hold circuit for measuring a voltage Vdiv across the second capacitance, the control device being further adapted to open the short-circuit switch when the first or the second switch is closed and to determine the voltage Vdiv across the second capacitance by means of the sample-and-hold circuit when the short-circuit switch is opened.

4. An energy converter as claimed in claim 3, characterized in that the detection signal is formed by the voltage Vdiv or a quantity corresponding there to.

5. An energy converter as claimed in 1, characterized in that the switching frequency at which the first and the second switch are switched is adjusted in dependence upon the detection signal by the control device.

6. An energy converter as claimed in claim 4, characterized in that, in operation, the control device adjusts the switching frequency on the basis of the value of Vdiv, such that the energy converter is operative in the inductive mode bordering on the near-capacitive mode.

7. An energy converter as claimed in claim 6, characterized in that the control device is adapted to control, in operation, the switching frequency in such a way that the value of Vdiv is controlled to a predetermined relatively small value.

8. An energy converter as claimed in claim 3, characterized in that, in operation, the control device re-opens the short-circuit switch after the sample-and-hold circuit has determined the voltage Vdiv.

9. An energy converter as claimed in claim 3, characterized in that the sample-and-hold circuit retains the voltage Vdiv until a new value of Vdiv is determined.

* * * * *